US010119795B2

(12) United States Patent
Daub et al.

(10) Patent No.: US 10,119,795 B2
(45) Date of Patent: Nov. 6, 2018

(54) FALLING TREE TARGET

(71) Applicant: TACTICAL AR500 TARGETS, INC., Ephrata, PA (US)

(72) Inventors: Jared Lynn Daub, Robesonia, PA (US); Ethan Verlan Sensenig, Denver, PA (US); Kirby Richard Sensenig, Denver, PA (US)

( * ) Notice: Subject to any disclaimer, the term of this patent is extended or adjusted under 35 U.S.C. 154(b) by 0 days.

(21) Appl. No.: 15/885,431

(22) Filed: Jan. 31, 2018

(65) Prior Publication Data

US 2018/0216921 A1 Aug. 2, 2018

Related U.S. Application Data

(60) Provisional application No. 62/452,419, filed on Jan. 31, 2017.

(51) Int. Cl.
*F41J 7/04* (2006.01)
*F41J 1/00* (2006.01)

(52) U.S. Cl.
CPC ... *F41J 7/04* (2013.01); *F41J 1/00* (2013.01)

(58) Field of Classification Search
CPC ..... F41J 1/00; F41J 7/04
USPC ..... 273/390–392, 406, 407
See application file for complete search history.

(56) References Cited

U.S. PATENT DOCUMENTS 4,093,227 A * 6/1978 Saunders ..... F41J 7/04 273/388
6,398,215 B1 6/2002 Carroll
6,994,348 B2 2/2006 Lambert et al.
6,994,349 B2 2/2006 Lambert et al.
7,690,656 B2 4/2010 Saunders
9,163,912 B1 10/2015 Stark
2005/0001381 A1* 1/2005 Lambert ..... F41J 7/04 273/348
2009/0174147 A1* 7/2009 Saunders ..... F41J 3/0004 273/392
2013/0207347 A1 8/2013 Sovine
(Continued)

FOREIGN PATENT DOCUMENTS

CN 202956032 U 5/2013
KR 19990000517 U 1/1999

*Primary Examiner* — Mark Graham
(74) *Attorney, Agent, or Firm* — Patent Law Associates

(57) ABSTRACT

A shooting target for use with high-power firearms comprising one or more movable targets moveably connected to an upstanding post. The post includes an elongate target guide structure defined by hollow cylinder with a guide slot in the cylinder wall. The target has a pivot section with a target arm extending generally perpendicularly therefrom and a distally disposed target face connected to the arm. The cylinder is sized to receive the pivot section therein so that the target arm extends outwardly though the guide slot, the guide slot configured to simultaneously direct movement of the target from one side of the guide to the other and downwardly as the target rotated in the guide structure following impact by a bullet. The target arm is configured to position the target adjacent to the upstanding post where it is visible to the shooter. The upstanding post is provided with a V-shaped impingement structure disposed facing the shooter and between the target support structure and the shooter. The upstanding post is also preferably angled toward the shooter to direct bullets downwardly upon impact with the target.

19 Claims, 13 Drawing Sheets

(56) References Cited

U.S. PATENT DOCUMENTS

| | | | |
|---|---|---|---|
| 2013/0328268 | A1 | 12/2013 | Eggiman et al. |
| 2015/0069707 | A1 | 3/2015 | Dunlop |
| 2015/0260486 | A1 | 9/2015 | Trimbath |
| 2015/0268013 | A1 | 9/2015 | Heise |
| 2015/0330748 | A1 | 11/2015 | Anzalone |

* cited by examiner

FALLING TREE TARGET

CROSS REFERENCE TO RELATED APPLICATIONS

This application claims priority benefit of U.S. provisional patent application Ser. No. 62/452,419 filed on Jan. 31, 2017.

BACKGROUND OF THE INVENTION

The present invention relates to a target used in shooting sports and, more particularly, a target system, commonly referred to as a falling dueling tree, in which a target is available to a shooter wherein the target moves laterally and vertically when hit by the shooter.

Metal shooting targets have been available on the market for many years. Some of those currently available on the market have multiple moving parts subject to wear especially in an outdoor environment. Others are designed for low power firearms such as rim-fire rifles and hence are destroyed by high power firearms. Still others may have a fixed target.

Increased availability of high-strength, ballistic steel plate has led to the availability of many such targets for high power firearms. One such target is known as a dueling tree wherein the dueling tree has multiple targets disposed upon an upstanding post, each target adapted to easily pivot from one side to another side in substantially the same vertical position upon the post. See, for example, U.S. Pat. Nos. 6,994,348 and 6,994,349 to Lambert, et al. Another such target comprises one or more movable targets are disposed upon an upstanding post, each target adapted to pivot from one side to another side upon impact by a projective and move downwardly during the pivoting movement. See, for example, U.S. Pat. No. 6,398,215 to Carroll.

Tradeoffs in constructing a movable target for high power firearms generally exchange target motion arrangements that are difficult to fabricate and provide crude control of target movement in exchange for a target motion designs that can be easily protected from bullet impacts and sufficiently robust to withstand the high impact forces resulting when bullets contact the target plates. A moveable target for high power firearms that is robust, protected from bullet impacts, easily fabricated, and offering more controlled movement of target plates would provide significant advantages over the prior art.

SUMMARY OF THE INVENTION

Accordingly, the present invention, in any of the embodiments described herein, may provide one or more of the following advantages:

It is an object of the present invention to provide a target system comprising an upstanding post having one or more targets moveably connected thereto, the targets moving from one side of the post to the other upon being struck by a bullet, each target moving downwardly coincident with the movement from one side to the other.

It is a further object of the present invention to provide a target system for use with high power firearms comprising one or move movable targets moveably connected to an upstanding post, each target having a pivot section with a target arm having a distally disposed target extending generally perpendicularly therefrom, the post having an elongate target guide structure defining a hollow cylinder with a guide slot in the cylinder wall, the cylinder sized to receive the pivot section therein so that the target arm extends outwardly though the guide slot, the guide slot directing movement of the target as it is impacted by a bullet.

It is a further object of the present invention to provide a moveable target system for use with high power firearms configured to shield the portions of the target that enable target movement from bullet or bullet fragment impingement. The upstanding post is provided with a V-shaped impingement structure disposed facing the shooter and between the target guide structure and the shooter. The upstanding post is also preferably angled toward the shooter to direct bullets downwardly upon impact. The angled post also angles the target faces downwardly for the same bullet deflection.

It is a still further object of the present invention to provide a target system for use with high power firearms comprising one or move movable targets moveably connected to an upstanding post, the targets moving from one side of the post to the other upon being struck by a bullet, each target moving downwardly coincident with the movement from one side to the other that is durable in construction, inexpensive of manufacture, carefree of maintenance, easily assembled, and simple and effective to use.

These and other objects are achieved in accordance with the present invention by providing a shooting target for use with high-power firearms comprising one or more movable targets moveably connected to an upstanding post. The upstanding post is ground supported on a base structure and extends vertically or may be angled in a manner position the distal end of the post nearer to the shooter. The post includes an elongate target guide structure defined by hollow cylinder with a guide slot in the cylinder wall. Each target has a pivot section with a target arm extending generally perpendicularly therefrom and a distally disposed target face connected to the target arm. The cylinder is sized to receive the pivot section therein so that the target arm extends outwardly though the guide slot, the guide slot configured to simultaneously direct movement of the target from one side of the guide to the other and downwardly as the target rotated in the guide structure following impact by a bullet. The target arm is configured to position the target adjacent to the upstanding post where it is visible to the shooter. The upstanding post is provided with a V-shaped impingement structure disposed facing the shooter and between the target support structure and the shooter. The upstanding post is also preferably angled toward the shooter to direct bullets downwardly upon impact with the target.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience, and are determined as the target would normally rest on the ground or a similarly level surface. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Figure 1:
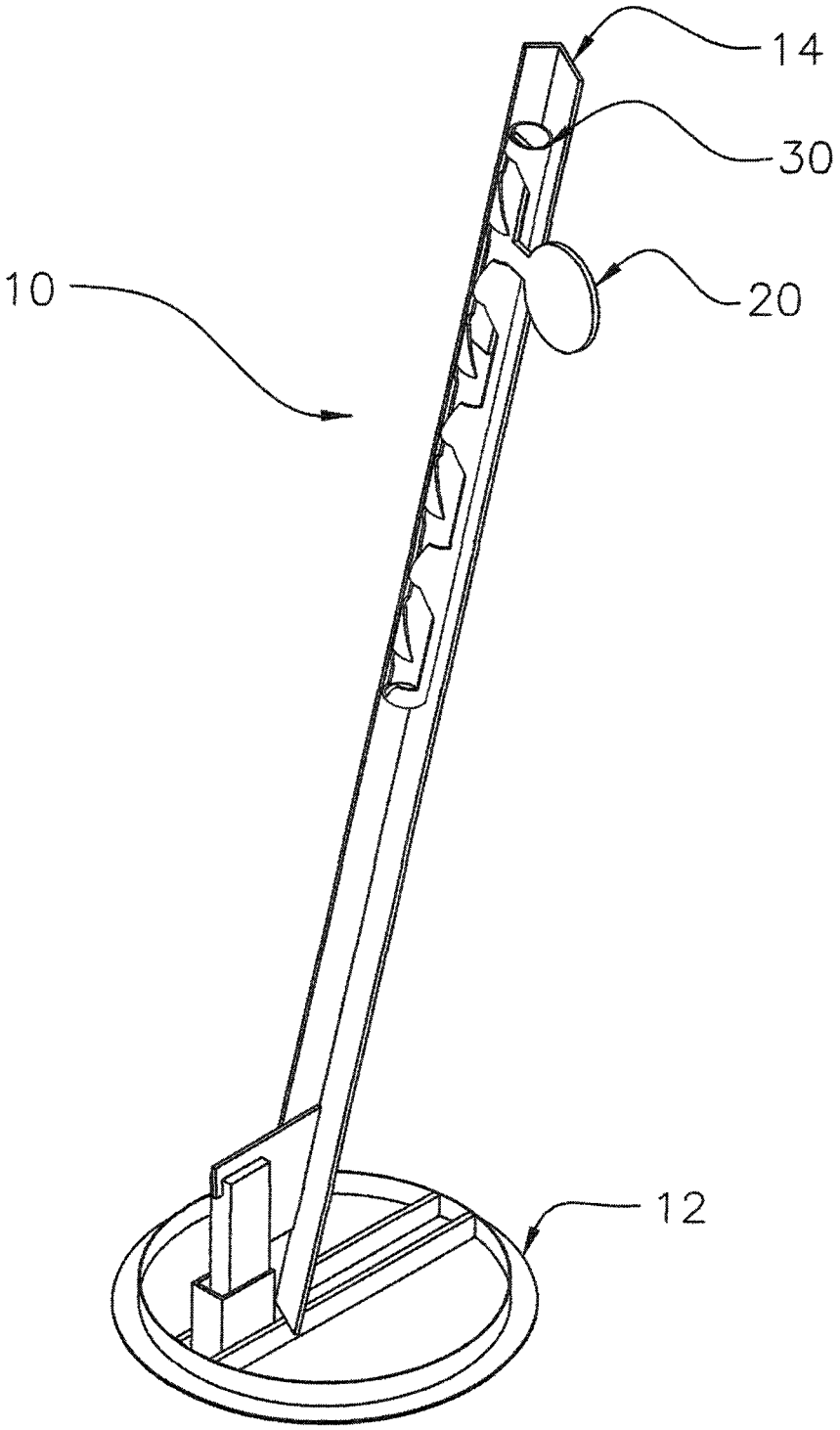
FIG. 1 is a perspective view of the moveable target systems embodying aspects of the present invention.
Figure 2:
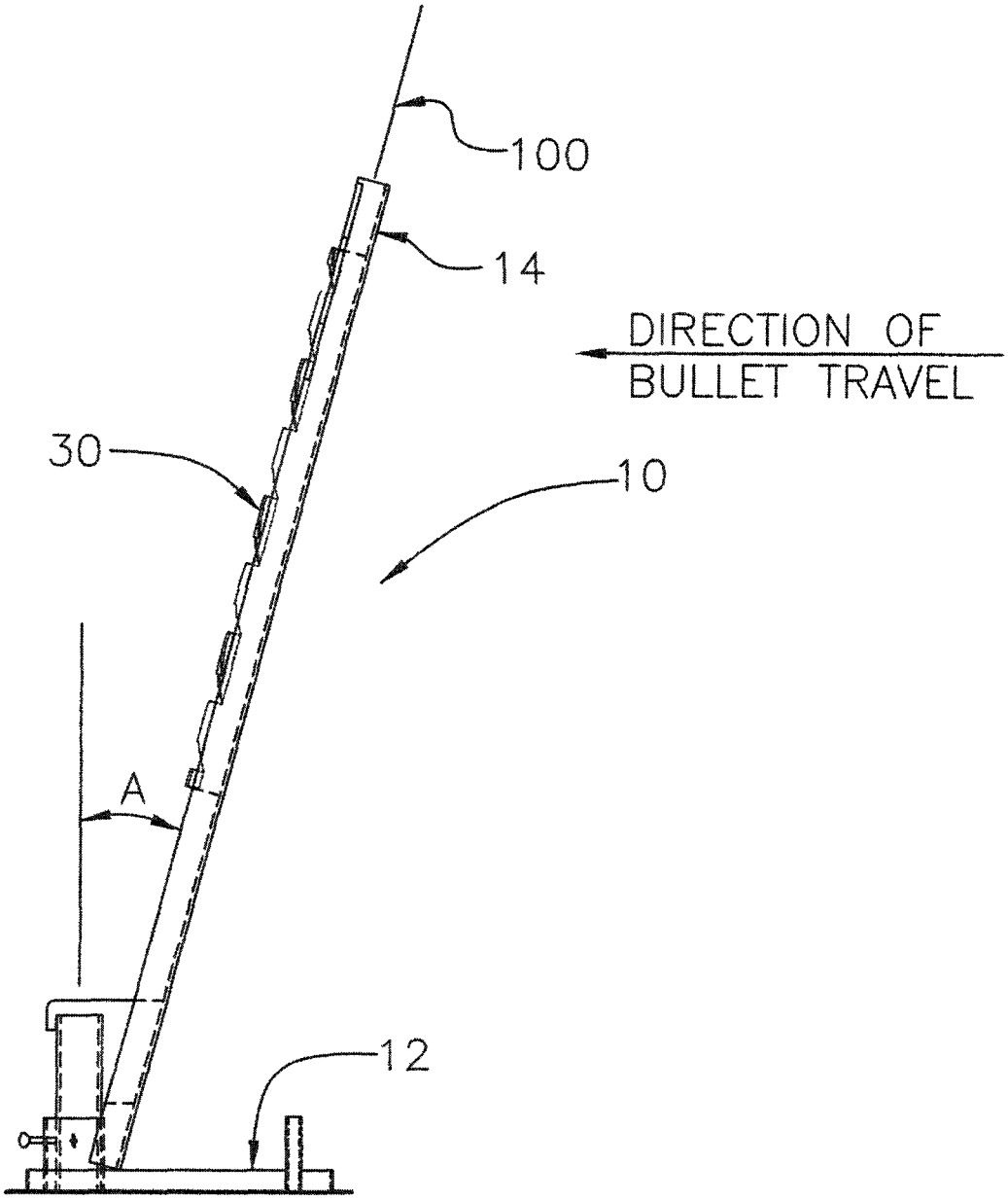
FIG. 2 is a side elevation view of the target system shown in FIG. 1.
Figure 3:
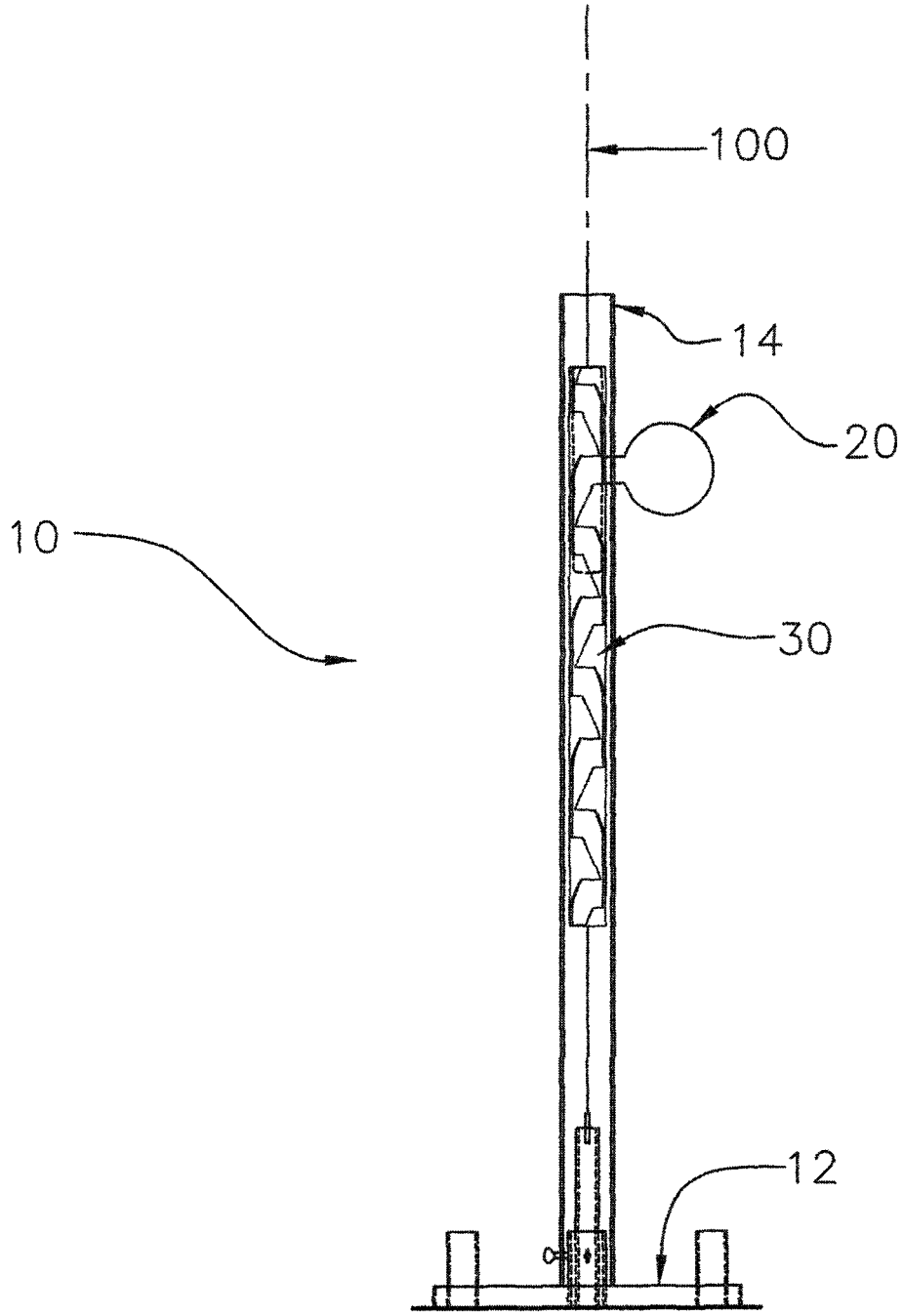
FIG. 3 is an elevation view of the target system of FIG. 1.
Figure 4:
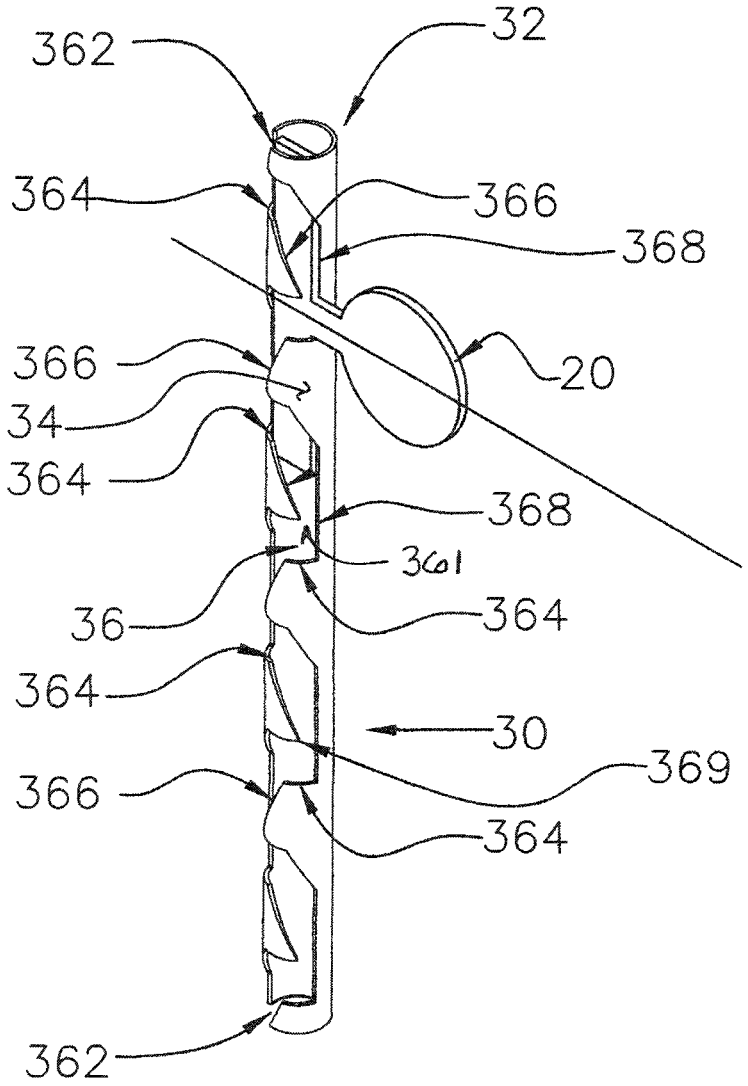
FIG. 4 is an isometric view of one embodiment of a guide structure used on the target system of FIG. 1.
Figure 5:
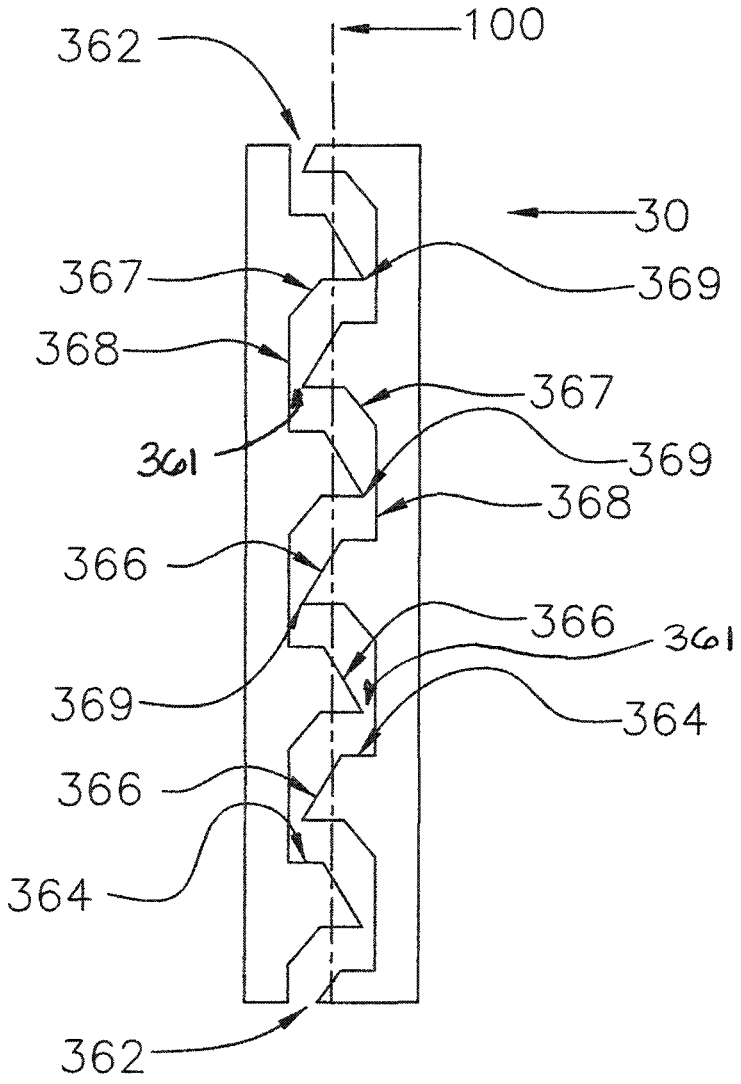
FIG. 5 is an elevation view of the guide structure showing the configuration of the guide track in a planar form.

Referring generally to the Figures and specifically to FIGS. 1 through 3, there is illustrated an exemplar target system 10 comprising a base structure 12 supporting an upstanding post 14. A proximal end of the post is connected to the base, either fixedly or removably, while the distal end is typically free standing. The post further comprises a target guide structure 30 disposed on the post 14 generally adjacent to the distal end and aligned on the upstanding axis. One or more target assemblies 20 are connected to the guide structure 30 in a moveable manner, movement and extend laterally from the post so as to be visible to a shooter positioned uprange of the target system, referred to as a battery or firing position. Though not shown, it is conceived that a single base structure 12 might support multiple, adjacent posts 14 to enable multiple shooters to compete against one another or to expand the target options for an individual shooter.

Referring to FIGS. 1 through 7, the guide structure 30 preferably includes a hollow cylinder 32 defined by a side wall 34 arranged about a longitudinal centerline 100 and a slot-like guide track 36 formed in the side wall extending from the interior to the exterior of the cylinder. The cylindrical configuration allows a target assembly cut from steel plate to more freely pivot within the guide structure hollow interior. Other hollow shapes may be utilized, but may require additional features to be incorporated on the target assembly 20 to assure proper target rotation. The guide track 36 is generally disposed on one half of the periphery of the cylinder side wall, the downrange side, and extends for the entire length of the cylinder 32 with openings 362 at each end of the cylinder enabling access to the slot. The guide track is precision cut as a single opening through the cylinder wall which improves target movement through the track and functional lifespan of the target system, especially when compared to similar target systems in which the target guides are fabricated using welded connections and joints.

Figure 6:
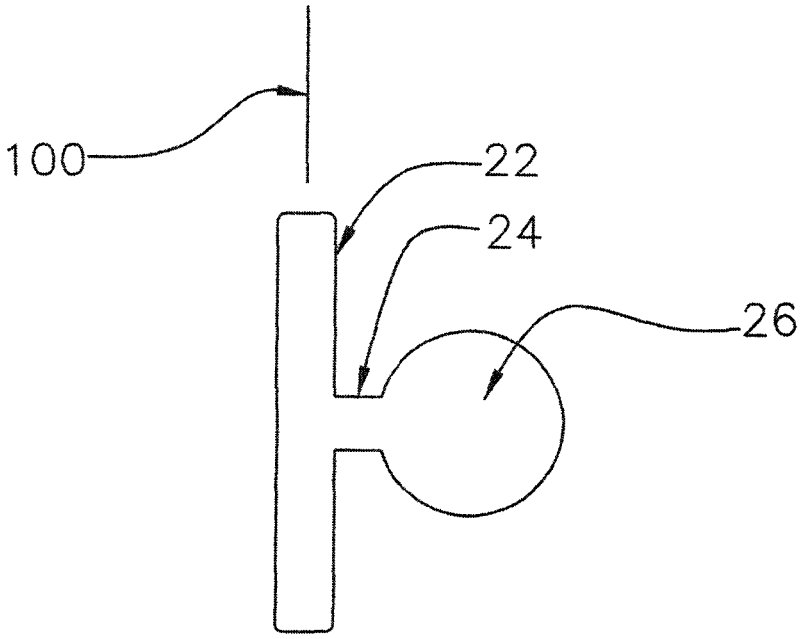
FIG. 6 is a detailed view of the target used in the target system of FIG. 1.

One or more movable target assemblies 20 are connected to the post 14 via the guide structure 30. As best illustrated in FIGS. 3 and 6, each target assembly comprises a pivot section 22 with a target arm 24 extending generally perpendicularly therefrom and a distally disposed target face 26 connected to the target arm 24. The target assembly is preferably formed as a unitary structure from metal plate that is generally planar in nature. In the exemplar embodiment, a plate thickness of ⅜ inch is used. Different plate thickness may be selected dependent upon the power of the weapons with which the target will be primarily used. The pivot section 22 is sized to fit within the guide structure 30 with sufficient diametric clearance to permit rotational movement thereof. The pivot section 22 also has sufficient length along the longitudinal axis 100 of the guide structure 30 to stably support the cantilevered target arm 24 and target face 26 without binding in the guide structure interior. In the exemplar embodiment, the pivot section 22 is 1⅞ inches wide formed from ⅜-inch thick plate which fits within the inside diameter of the 2-inch pipe of the guide structure and permits rotational movement while maintaining the target sufficiently aligned within the guide structure 30 to maintain alignment in the guide structure 30 and guide track 36. The length of the pivot support in the exemplar target assembly 20 is approximately 13½ inches, though the length may be altered dependent upon the size of the desired target face 26. The target arm 24 extends laterally, preferably perpendicularly to the rotational axis 100 from the pivot section 22 and projects through the guide track 36 and extend laterally a distance sufficient to assure that the target face 26 is visible to the shooter.

The guide track 36 is contacted by the target arm 24 to support the weight of the target assembly 20. Due to the circular cross section of the guide structure, the point of contact between the guide track 36 and the target arm 24 remains generally uniformly spaced from the centerline of the guide structure 30 and the pivot section 22 which creates uniform friction forces thereby improves the motion of the target assembly 20 as it rotates from one side of the guide structure to the other.

The guide track 36 further comprises a plurality of lands 364 upon which the target rests when positioned to be viewable to a shooter (battery or firing position) thereby managing vertical position of the target, a plurality of stops 368 which limit the degree of rotational movement of the target assemblies when moving from side to side about the guide structure, and establish the outward target extension when in the firing position, and a plurality of lower and upper ramps 366, 367 forming a generally helically shaped guide which directs the target assemblies between adjacent lands 364. The helical shape, including ramped portions disposed above and below the target arm 24 both permit the target assembly to drop as it rotates and forces the target assembly downwardly as it rotates from one side of the guide structure 30 to the other after being struck.

The lands 364 are arranged so that each is positioned on the side of the cylinder opposite of the vertically adjacent lands. From each land 364 extends a lower ramp 366 which is angled downwardly from the land to allow gravitational force to rotate the target assembly as it slides along the lower ramp and the drop toward the next land below on the opposite side of the cylinder when the target reaches the end of the respective lower ramp as the target pivots after impact by a bullet or similar projectile. The transition from the land 364 to the adjacent lower ramp 366 is positioned such that the target assembly will rotate from an initial firing position ($P_1$ in FIG. 7) and engage the lower ramp thereby causing the target assembly to continue to rotate until the target is positioned in the next adjacent firing position ($P_2$ in FIG. 7) on the opposite side of the guide structure. This initial rotation (arc "I" in FIG. 7) is established so that even shots that do not impart maximum energy to the target are likely to rotate the target assembly sufficiently to shift the target position to the next firing position whereupon it is next visible to the shooter. An initial arc rotation arc "I" of 15 to 25 degrees is preferred.

Figure 7:
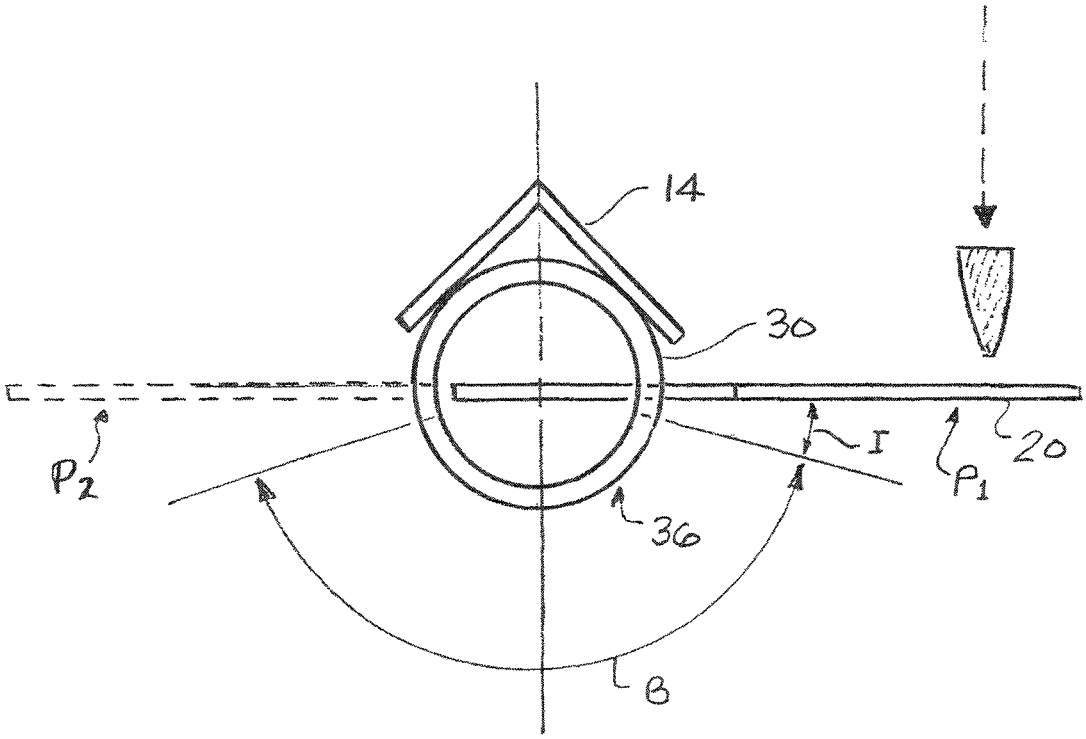
FIG. 7 is an overhead view looking along the target guide structure illustration the rotation of the target assemblies.
Figure 8:
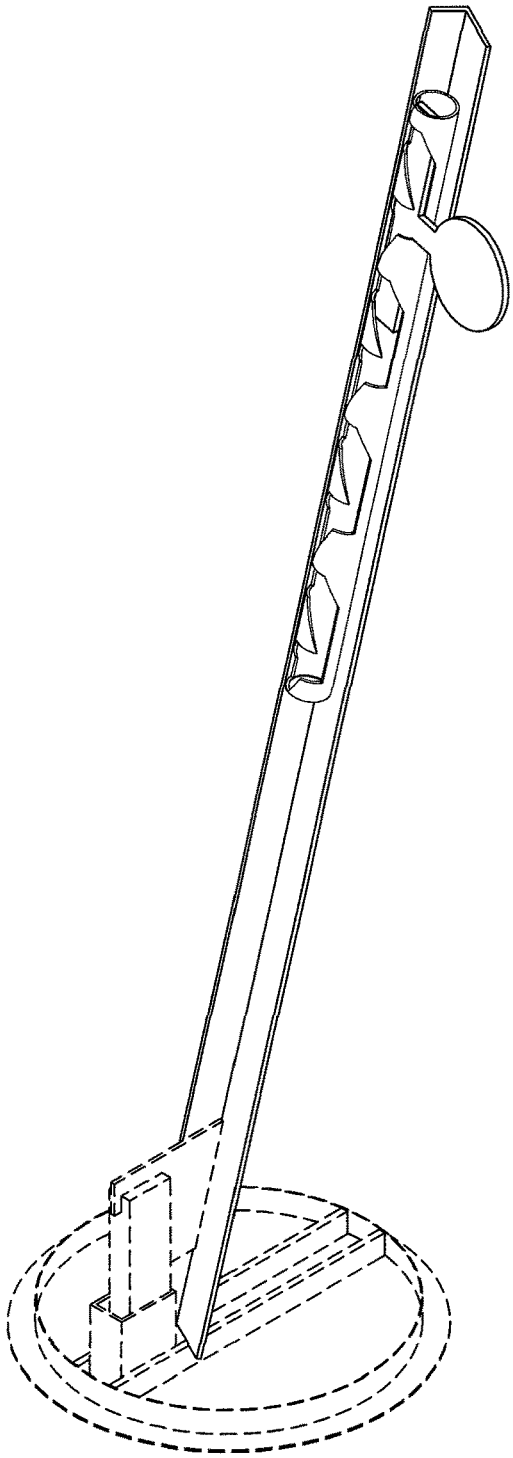
FIG. 8 is an left side isometric view of the target system.
Figure 9:
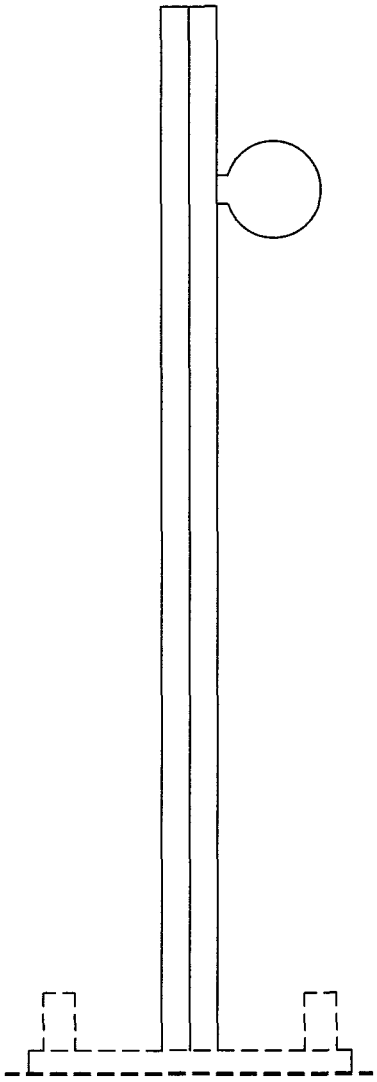
FIG. 9 is a front elevation view of the target system of FIG. 8.
Figure 10:
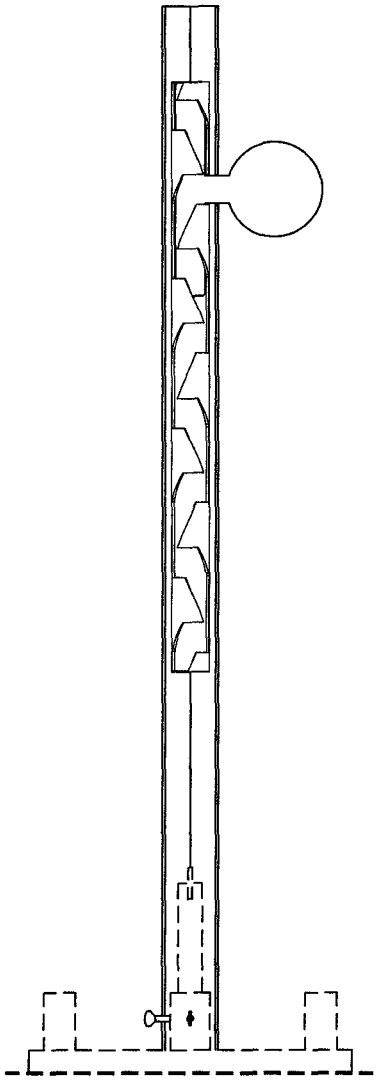
FIG. 10 is a rear elevation view of the target system of FIG. 8.
Figure 11:
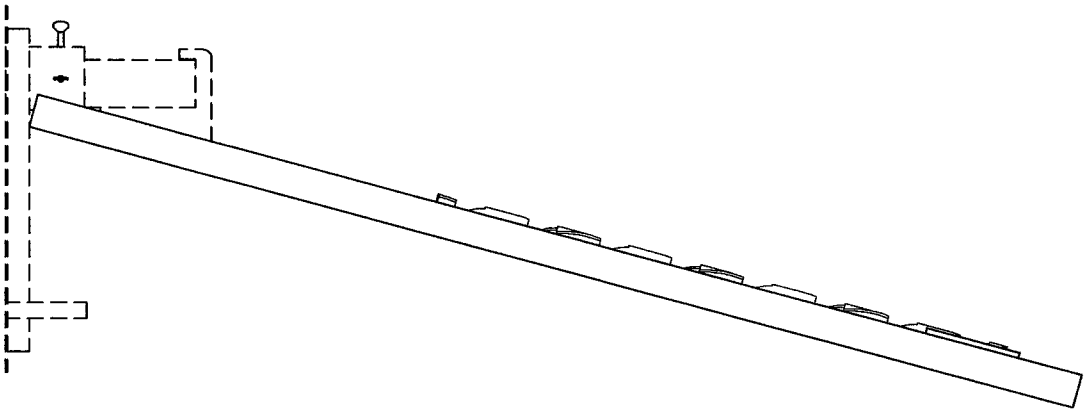
FIG. 11 is a left side elevation view of the target system of FIG. 8.
Figure 12:
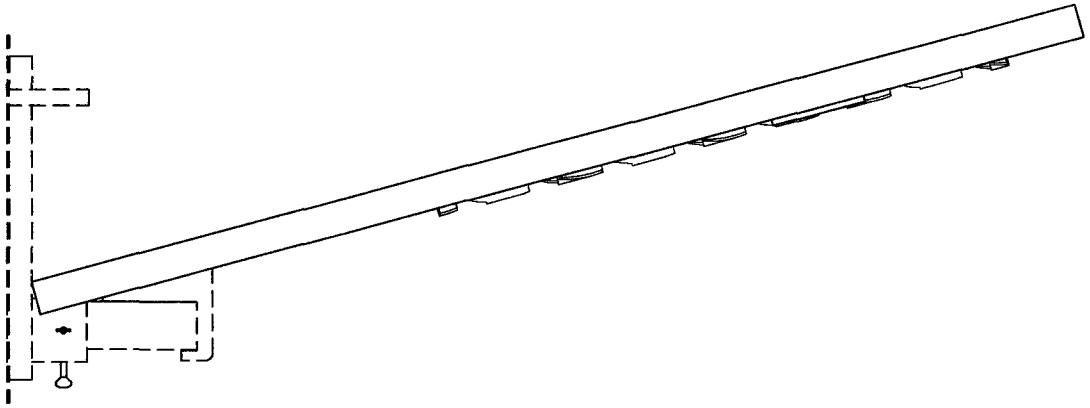
FIG. 12 is a right side elevation view of the target system of FIG. 8.
Figure 13:
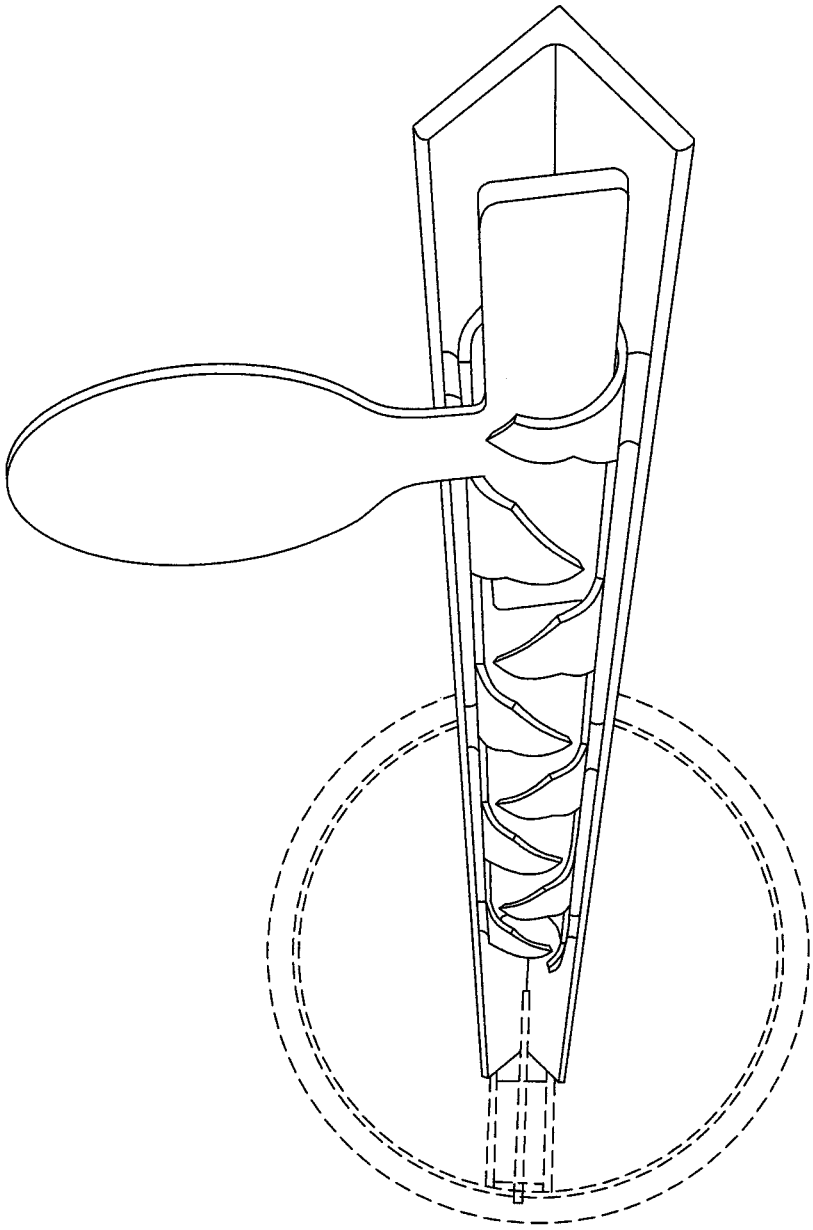
FIG. 13 is a top view of the target system of FIG. 8.

An upper ramp 367 is spaced apart from and disposed generally parallel to the lower ramp 366 to deflect the target assembly 20 downwardly as the target assembly rotates following impact by a bullet. When high powered rounds are fired, the target may rotate with sufficient inertial energy so that it may not immediately drop to follow the lower ramp 366 as it rotates. In such instances, the target assembly 20 impacts the upper ramp 367 which deflects the target assembly downward and prevents it from bouncing back to its initial position. As best illustrated in FIG. 7, the extent of the lower ramp 366 (arc "B") is sufficient in range to assure that the target rotates to position the target face on the opposite side of the guide structure before allowing the target to drop to the land below. The range of the lower ramp portion is such that the target assembly should be engaged on the lower ramp prior to the target assembly rotating one-quarter turn from the shooting position (target assembly extends behind the guide structure). It is preferably that the ramp portion occupy an arc of at least 90 degrees. An arc "B" of the ramp portion of approximately 135 degrees is preferred. Combined with the preferred forward tilt of the guide structure, the target assembly 20 is repositioned to the firing position below ($P_2$ in FIG. 7) once the target is struck and rotation initiated by a bullet.

The target assembly 20 may impact the lower ramp 366 after contacting the upper ramp, but the combination of the upper and lower ramps and the helical path defined between the ramps guides the target until is rests on the land 364 below and is generally adjacent to the stop 368 on the opposite side from where it was previously positioned. A downward angle ranging between 45 and 75 degrees from horizontal is preferred to minimize the likelihood of the target bouncing back to its initial position once struck by the bullet. Increasing the downward angle improves target movement at the expense of limiting the number of lands (target positions) available on the target system. In one embodiment, the ramps are angled downwardly approximately 59 degrees from the horizontal land. The lower ramps 366 each terminate in an end 369 that is positioned proximate to the stops 368 with sufficient space therebetween for the target assembly 20 to pass downwardly under certain rotational orientations, generally when the target assembly 20 is positioned proximate the stop 368, so that the target drops to the next land 364. The stops 368 define the range of target rotation when moving from one side of the cylinder to the other. The range of rotation is generally 180 degrees, though the range may be slightly increased or decreased to enable angling of the target relative to the incoming bullets to be adjusted and avoid perpendicular impacts.

In the exemplar embodiment, the guide structure 30 is formed from a length of two-inch nominal diameter ANSI Schedule 40 steel pipe. This pipe features an inside diameter slightly larger than 2 inches and nominal wall thickness of 0.15 inches. Pipe having a stronger material specification or an increased wall thickness may be employed to improve target durability. A guide structure length of approximately three feet enables four target positions on each side of the upstanding post 14. Upon the last successful shot, the target assembly 20 will be disengaged from the bottom of the guide structure 30 and drop to the ground. To continue shooting, the user must return the target to the guide track at the top of the guide structure.

The upstanding post is preferably formed from a durable material capable of withstanding repeated impacts of projectiles (bullets) fired from high power firearms. Suitable materials include ballistic steel plate, such as MIL-A-12560, MIL-A 46100 or the like, and abrasion resistant (AR) steel plate, such as AR-500. Abrasion resistant plate is preferred for economic considerations. Durability of the post is improved by configuring the post with faces angled relative to the projectile travel path. A vee-shaped post profile wherein the apex of the vee is oriented uprange accomplishes this objective and deflects the bullet laterally. It is also known to angle the entire post such that the distal end is oriented further uprange than the proximal end to deflect impacting bullets downwardly. The exemplar embodiment is angled (FIG. 2) approximately 15 degrees from vertical in the uprange direction to deflect impacting bullets generally downwardly and reduce the occurrence of perpendicular impacts. The post design protects the guide structure and permits its construction using regular steel pipe. The forward angle also returns the target face 26 to the firing position in the event of a partial strike that imparts insufficient energy to the target face to rotate the target into the ramped portion of the guide track.

Similarly, the target assembly is 20 preferably formed from a durable material capable of withstanding repeated impacts of projectiles (bullets) fired from high power firearms. As the target faces are intended to be impacted by bullets, they are subjected to significant wear and degradation and thus require periodic replacement. For these, the economics leads to a preference for the less expensive AR plate over the costlier ballistic plate. The target assembly is also preferably precision cut from a single plate of material; eliminating welded connections in the target assembly significantly improves functional durability of the overall target system as well as useful lifespan of the target assembly itself.

Naturally, the invention is not limited to the foregoing embodiments, but it can also be modified in many ways without departing from the basic concepts. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A shooting target system comprising:

a ground-supported generally upstanding support;

a target assembly having a target face connected by a support arm to a pivot portion; and an elongate, cylindrical target guide structure upstandingly connected to the support, the guide structure having a hollow interior portion encircled by a wall and a guide slot through the wall and spanning the entire length of the guide structure;

the interior portion sized to moveably receive the pivot portion, the guide slot having a plurality of lower ramps, a plurality of upper ramps, and a plurality of landings, each of the plurality of landings having a stop which limits rotation of the target assembly so the target face is positioned in one of a plurality of firing positions laterally beside the guide structure where it is visible to a shooter, each upper and lower ramp being spaced apart to permit the support arm to extend therethrough, the upper and lower ramps downwardly angled to guide the target face downwardly as the target assembly rotates the target face from one side of the guide structure to the other after being struck by a projectile, each upper ramp being angled to deflect the support arm downwardly as the target assembly rotates.

2. The target system of claim 1, wherein respective upper ramps and adjacent lower ramps are impacted by the target assembly support arm as the target assembly rotates after being struck by the projectile and angled generally downwardly in relation to rotation of the target assembly to urge the target assembly downwardly and prevent the target assembly from returning to the firing position in which it was initially disposed when struck by the projectile.

3. The target system of claim 2, wherein each lower ramp includes an end disposed adjacent to a respective stop defining a gap through which the support arm may drop vertically to a landing below, the gap rotationally aligning the target assembly in one of the plurality of firing positions.

4. The target system of claim 3, wherein the target assembly movement is limited to vertical when dropping through any of the respective gaps.

5. The target system of claim 1, wherein respective adjacent pairs of the upper and lower ramps are helically shaped and generally uniformly spaced apart.

6. The target system of claim 5, wherein the target assembly engages the respective lower ramp after rotating no more than 45 degrees from the shooting position.

7. The target system of claim 6, wherein each lower ramp arcuately spans at least 90 degrees of the guide structure wall as viewed from an end of the guide structure.

8. The target system of claim 1, wherein the downward angle of each of the upper and lower ramps is in the range between 45 and 75 degrees from horizontal.

9. The target system of claim 1, wherein the guide structure is forwardly angled toward the shooter.

10. The target system of claim 9 wherein the guide structure is forwardly angled approximately 15 degrees from vertical.

11. A shooting target system comprising:

a target assembly having a target face connected by a support arm to a pivot portion;

a generally upstanding target guide structure having spaced apart upper and lower ends, and a hollow, generally cylindrical interior portion surrounded by a wall, the interior portion configured to receive the pivot portion in a manner enabling rotational and axial motion of the target assembly; and a guide track opening in the wall spanning the entire length of the guide structure, the guide track configured to receive the target assembly in a top opening in the guide track adjacent to the upper end such that the pivot portion is at least partially disposed in the hollow interior portion and the support arm extends outwardly through the guide track opening, the guide track having a plurality of stops and landings arranged to maintain the target assembly in one of a plurality of fixed firing positions, the guide track guiding the target assembly downwardly responsive to the target face being struck by a projectile along a succession of firing positions, each successive firing position locating the target face on the opposite side of the guide structure and downwardly displaced from the preceding firing position, movement of the target assembly occurring as the pivot portion rotates in the guide structure interior portion and interaction between the support arm and the guide structure urges the target assembly downwardly as it rotates.

12. The target system of claim 11, wherein the guide track further comprises a plurality of lower ramps, each being downwardly angled to gravitationally urge the target to rotate toward the opposite side of the guide structure after being struck by a projectile, and a plurality of upper ramps spaced apart from respective lower ramps defining a generally slot-like opening through which the support arm extends, each upper ramp being downwardly angled to force, upon contact with the support arm, downward movement of the target assembly as it rotates.

13. The target system of claim 12, wherein each respective pair of upper and lower ramps are generally uniformly spaced apart and define proximately to the ramps, a generally helical opening in the guide structure wall.

14. The target system of claim 12, wherein each lower ramp includes an end disposed adjacent to a respective stop defining a gap through which the support arm may drop vertically to a landing below, the gap rotationally aligning the target assembly in one of the plurality of firing positions.

15. The target system of claim 14, wherein the target assembly engages the respective lower ramp after rotating no more than 45 degrees from the shooting position.

16. The target system of claim 14, wherein the downward angle of each of the upper ramps is in the range between 45 and 75 degrees from horizontal.

17. The target system of claim 16, wherein each of the plurality of upper and lower ramps arcuately extend for at least a 90 degree arc of the guide structure wall.

18. The target system of claim 11, further comprising a ground-supported generally upstanding support connectable to the guide structure which forwardly angles the guide structure toward a shooter.

19. The target system of claim 18, wherein the guide structure is forwardly angled approximately 15 degrees from vertical.

* * * * *